US005476339A

United States Patent [19]

Baranowski

[11] Patent Number: 5,476,339

[45] Date of Patent: Dec. 19, 1995

[54] ACCESS PATHWAY FOR DEPLOYMENT OVER UNEVEN TERRAIN SURFACES THAT ARE RESISTANT TO THE ROLLING TRACTION ON A WHEELCHAIR

[76] Inventor: Edwin M. Baranowski, 75 Marrus Dr., Gahanna, Ohio 43230

[21] Appl. No.: 157,719

[22] Filed: Nov. 26, 1993

Related U.S. Application Data

[63] Continuation-in-part of Ser. No. 826,838, Jan. 27, 1992, Pat. No. 5,319,818.

[51] Int. Cl.[6] ..... E01C 9/08; E01C 15/00

[52] U.S. Cl. ..... 404/36; 52/180

[58] Field of Search ..... 404/18, 19, 21, 404/36; 238/14; 52/180

[56] References Cited

U.S. PATENT DOCUMENTS

| | | | |
|---|---|---|---|
| 1,325,575 | 12/1919 | Niewoehner | 238/14 |
| 1,375,666 | 4/1921 | Bauer | 238/14 |
| 1,650,254 | 11/1927 | Zesinger | 238/14 |
| 1,952,721 | 3/1934 | MacChesney et al. | 404/36 X |
| 3,335,645 | 8/1967 | Eisenberg | 404/36 |
| 3,425,624 | 2/1969 | Jacobs | 238/14 |
| 3,786,989 | 1/1974 | Haynes | 238/14 |
| 4,265,399 | 5/1981 | Covington | 238/14 |
| 4,478,901 | 10/1984 | Dickens et al. | 404/36 X |
| 4,528,711 | 7/1985 | Packer | 14/69.5 |
| 4,712,264 | 12/1987 | Voith | 14/69.5 |
| 4,874,284 | 10/1989 | New, Jr. | 14/69.5 X |
| 4,998,670 | 3/1991 | Peterson | 238/14 |

FOREIGN PATENT DOCUMENTS

| | | | |
|---|---|---|---|
| 4011302 | 10/1991 | Germany | 404/36 |

*Primary Examiner*—Ramon S. Britts
*Assistant Examiner*—James A. Lisehora

[57] ABSTRACT

A pathway for providing the transit of a wheelchair, including a person therein, over an uneven terrain surface that resists the rolling traction of a wheelchair, comprising a longitudinally extended flexible mat-like pathway configured such that the surface of the pathway is relatively porous with respect to the terrain surface, such as by providing therein a plurality of holes, and is capable of receiving thereon, at opposite side sections thereof, the front and side wheels of each side of a wheelchair. The pathways may be interconnected to pod-like landing sites.

20 Claims, 1 Drawing Sheet

ACCESS PATHWAY FOR DEPLOYMENT OVER UNEVEN TERRAIN SURFACES THAT ARE RESISTANT TO THE ROLLING TRACTION ON A WHEELCHAIR

This application is a continuation-in-part of application Ser. No. 07/826,838, filed Jan. 27, 1992, now U.S. Pat. No. 5,319,818.

FIELD OF THE INVENTION

This invention relates to accessibility means for persons in wheelchairs (or wheelchair challenged persons.)

BACKGROUND OF THE INVENTION

Wheelchair access on a beach, lawn, or other uneven or slippery surface is difficult. Often the wheelchair challenged person is an occasional visitor. Other times, the installation of a permanent wheelchair access path is expensive, and intrusive to the natural environment. Prior art mechanisms for beach access include installations such as boardwalk extensions and concrete piers supporting platforms extending to the beach, and/or into the ocean or (body of water). Sand is a notorious barrier to wheeled traction, and the particularly narrow wheels of a wheelchair compound the difficulty of moving in a wheelchair over a sandy beach. Further, the generally immobile and permanent prior art installations, predetermine a fixed path only, over which the wheelchair may pass. There is thus a need for a simple and conveniently deployed access pathway that is useful with wheelchairs that will provide a passage means from Point A to distant Point B over terrain surfaces that resist the rolling traction of the wheelchair.

It is an object of this invention to provide a means for the transit of a wheelchair (including a person in the wheelchair) over sand, a beach, or other uneven, traction resisting surface, such as a desert, lawn and the like. It is a further object to provide such means in a temporarily deployable system, so that the presenting environment is not significantly disturbed, and conventional environmental maintenance, such as the periodic raking of a beach, or mowing of a lawn, is not appreciably interfered with, because the pathway, in certain applications, can be easily removed and replaced.

It is also an object of the invention to provide a retractable, and inexpensive, mechanism that allows the transit of wheelchairs over presenting surfaces that can generally be characterized as traction barriers to rolling conveyances. The mechanism may be permanent, temporary, or temporarily and removably installed, to allow removal when not needed or when maintenance needs require. The mechanism may also be adapted to be adjustable in direction or length and provides a greater degree of freedom for the wheelchair user to predetermine her or his location at a distant desired site on the terrain involved.

These and other objects of the invention will be more readily understood when considered with the accompanying drawings:

DESCRIPTION OF THE PREFERRED EMBODIMENT

Figure 1:
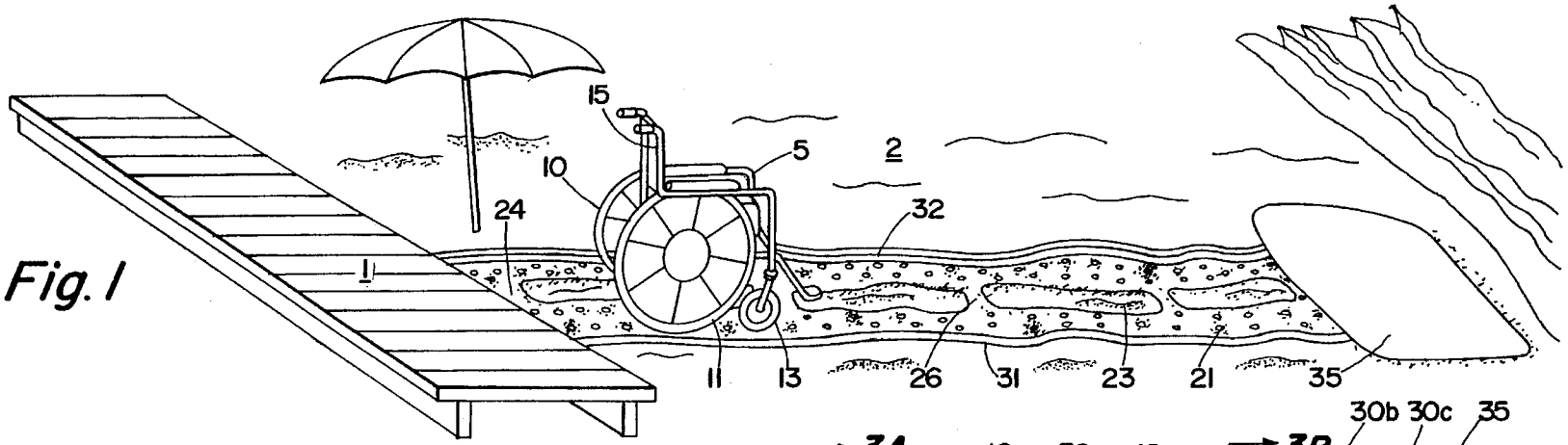
FIG. 1 shows, in perspective, a wheelchair traversing the pathway of the invention as deployed from a boardwalk at a beach.

The invention provides a pathway for the transit of a wheelchair over a barrier that is resistant to the rolling traction of a wheelchair, such as sand at a beach or desert, a lawn (particularly a wet lawn), and ice or snow. With reference to FIG. 1, a beach scene is shown, having a boardwalk 1, sand beach 2, ocean (or body of water) 3, and pathway 4, on which wheelchair 5 is transported. (For purposes of clarity, a person in the wheelchair is not shown, but is assumed to be present. Reference to a "wheelchair" in context herein, generally includes a person seated therein.)

The wheelchair is a conventional chair having rear side wheels 10 and 11, front side wheels 12 (not shown in the view of FIG. 1) and 13, seat 14 and back 15.

Figure 3A:
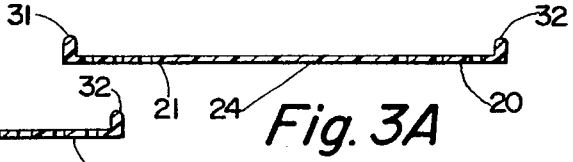
FIG. 3A is a cross-section of the pathway shown in FIG. 2 at the section indicated at 3A→←3A.

The pathway 4 is longitudinally extended and is formed by two path sections 20 and 21, spaced apart from each other and each having a width sufficient to accommodate the front and rear wheels of the wheels on one side of the wheelchair. The space between the paths 23 is preferably sufficiently wide to allow a human assistant to walk therethrough. Preferably, an end section of the pathway 24 is anchored, such as to a boardwalk 1 or other secure fixture, or to the beach ground. As shown, a lateral spacer section of the path (such as shown in the cross-section of FIG. 3A and in FIG. 1 as 24) is the anchor location at one end. In the transit of the wheelchair on the paths, each path receives the front and rear side wheels of the wheels on each of one side of the wheelchair; and the space between the spaced apart pathways is an opening that provides access to a footing surface on the terrain for an assistant, if required, to push the wheelchair.

Depending on size considerations required by wheelchair designs (such as track width and wheel spacing), each path is about 6 to 8 inches (15 to 20 centimeters) wide, and the paths are separated by about 10 to 12 inches (25 to 30 centimeters). As shown in the figures, the opposite sides of the path connections are connected by spacers 24 and 26, which may be formed intrinsically in a unit with the pathways. The longitudinal distance between spacers is optional and, for example, may be at intervals from approximately 3 feet (1 meter) to 6 feet (2 meters), although such spacing is not determined by preexisting dimensional requirements of the wheelchair as with path width and the path spacing.

Usually, the distance between a boardwalk and shore, or a desired beach location (i.e., from departure Point A to destination Point B, when the pathway is installed) will be measured in the tens of feet (or multiple meters). The paths may be temporarily deployed. Preferred materials for construction of the paths include fiber reinforced plastic or rubber type polymer mat material, having a high UV (ultraviolet ray) resistance (recognizing the outdoor use of the path), a flexible cross-linked polymer mat or other equivalent material. Depending on the availability of local materials, or beach or lawn aesthetic preference, a woven natural fiber such as hemp, or a wood slat construction, are also suitable. Likewise is a laminate or composite of fiber and polymer comparable to conventional indoor / outdoor carpet construction materials. An appropriate thickness for such paths would approximate that of a typical household carpet, about 0.25 inches (1 centimeter) or more. A suitably configured metal material, such as a wire mesh or chain link type design, configured as a mat herein, is also appropriate.

Figure 2:
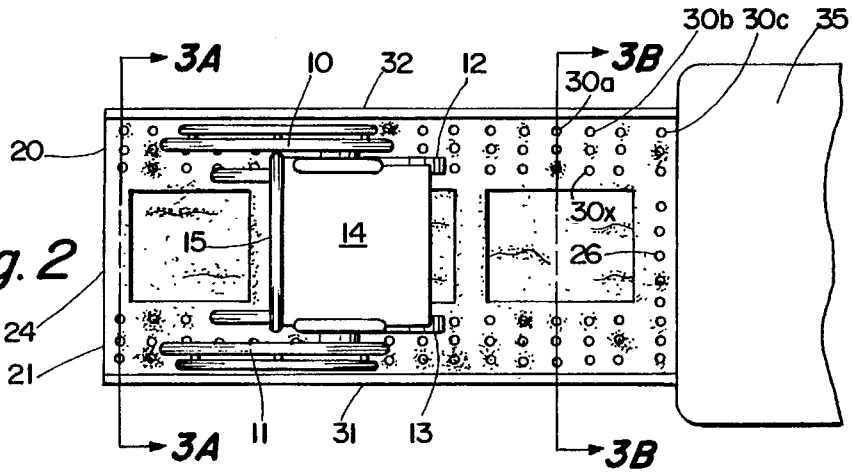
FIG. 2 is a top view of a wheelchair on a pathway of the invention.

As shown in greater detail in FIG. 2, the paths preferably include a pattern of holes, 30*a*, 30*b*, 30*c*, 30*x*, etc., formed therein. The occasional spacers 24 and 26, separated at longitudinal distances, fix and preserve the separation between the paths. Optional, upward extending "curb" sections, 31 and 32, at the side edges of the paths (approximately 0.25 to 1.0 inches ((1 to 4 centimeters) above the path surface)) provide a degree of guidance and/or assurance that the wheelchair does not deviate from the pathway. One or two such curbs, on one or both pathways may be provided.

Figure 3B:
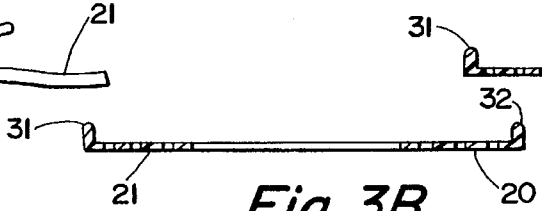
FIG. 3B is a cross-section of the pathway shown in FIG. 2 at the section indicated at 3B→←3B.
Figure 5:
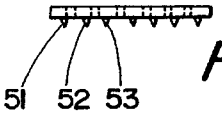
FIG. 5 is a cross-section of an alternative pathway material.

The holes in the paths (allow sand (or presenting terrain such as grass, snow, and the like) to penetrate up from the beach (terrain) and anchor the path thereon. After a brief period of time and/or use, the path, (for example, when used on sand) will "sink" slightly therein and become anchored. A benefit of this occurrence is that, as a result, the presence of the pathway will not greatly disturb the aesthetics of the beach environment. Similarly, grass from a lawn may migrate through the holes. The case with snow is comparable, however, depending on the depth of the snow, the path is likely to sink until an equilibrium with the weight of the wheelchair is achieved. In this regard, the path is "porous" with respect to the presenting terrain surface material (sand, grass, snow, etc.,) Hence, as used herein, the term "porous" refers to a holed material that permits the surface material underneath to migrate upwardly, in the case of a pathway of FIGS. 2, 3A and 3B, through the holes. In the case of a path having a cross-section such as characterized in FIG. 5, the terrain material migrates upward toward the bottom surface of the mat to anchor the mat on the terrain surface. In FIG. 5, a mat 50 is shown having downward projecting nibs 51, 52, 53, etc., extending from the bottom surface of the mat. The nibs may be conical, cylindrically-sectioned, cubical, or formed in any other three-dimensional shape, such that they have the characteristic with respect to upward migration of the terrain surface described above.

A combination of holes, such as shown in FIG. 2, and protruding nibs, such as shown in FIG. 5, may also be appropriate. Because a path in the form of FIG. 5 requires a greater volume or mass of material, it is likely to have a greater weight and higher cost, and is consequently less preferred.

The holes may be circular or curvilinear cutouts, a square, triangle, polygon or other multisided grid or random pattern. When path sections about eight inches (20 centimeters) wide are used, holes about two inches (five centimeters) in diameter are suitable. Although not critical, this dimension and relationship may be a function of terrain, wheelchair weight, wheel size and other factors. The holes should typically open approximately 20%–80% of the approximately rectangular surface area otherwise covered by the path sections on the terrain surface. Because the pathway is either regularly removed when maintenance of the surface is required, or temporarily deployed when needed, the pathway does not become "buried" in the terrain.

In the top view shown in FIG. 2, the beach, or other presenting terrain surface, is shown to protrude or extend upward through the path "holes." The rationale of operation of the pathway mechanism is that two relatively narrow, wheelchair supporting paths are provided, which, because they are "porous" as defined herein, settle firmly on the presenting, uneven surface. In contrast, if, for example, a solid carpet or mat were placed over the sand, the covering would be about 24 to 30 inches (60 to 75 centimeters) wide, extending 10, 20, 30 or more feet (3 to 10 or more meters.) The solid covering, because of the uneven nature of the beach terrain would not anchor itself and would not have an appropriate flat surface foundation. In addition, the appearance of such a solid surface would also disturb the natural beach environment. In contrast, the paths herein are sufficiently narrow and porous so that they readily conform to the uneven beach surface. The openings further reduce the weight of the pathway, enabling it to be easily rolled up and removed. A pathway formed from a solid, rigid bridge material similarly contrasts with the principles of operation of the invention.

Figure 4:
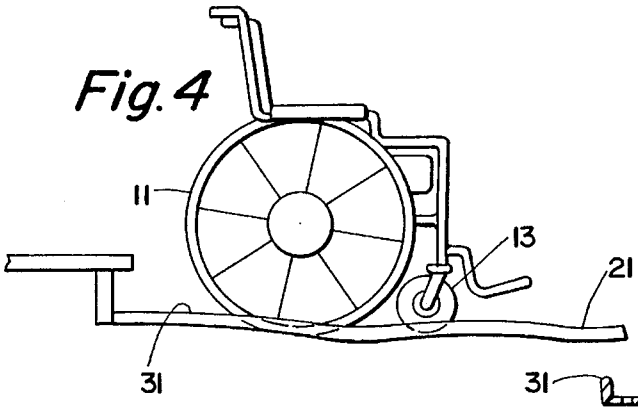
FIG. 4 is a side view of a wheelchair on a pathway in relationship to an anchor means, shown as a section of a boardwalk.

Depending on material selection, a pathway may be formed of a sufficiently lightweight material so as to be provided as a portable mechanism carried by the wheelchair challenged person (or an assistant) and rolled out on site. At an attended beach, however, such as at a hotel or park, the pathway could be anchored to a boardwalk (i.e., a pre-existing accessibility path) as shown in FIG. 4, or elsewhere, and deployed by lifeguards or beach attendants when needed. A ground fault protected, electrically powered system (or otherwise powered system) may also be adapted for unrolling and rolling up the pathway. To a degree, because of its flexible and porous nature, and its intrinsic weight, the pathway may also be considered self-anchoring. Or alternatively, for example, the pathway may be anchored to a tree, rock, recreational vehicle or other relatively fixed mass in the environment of the terrain intended to be crossed.

The pathways my be directed to, equipped with, or joined to "pod" like sections at an end thereof (e.g., square sections about 30×30 inches (75×75 centimeters), or rounded or other shaped equivalent extended surface areas) to provide a positional destination, or to allow turning movement of the wheelchair thereon, and from these sections, other pathway sections in turn may lead to other pods. (Such a pod is shown in part at 35 in FIG. 2. Similarly, pods for wheelchair locations may be fixed, or may be independently positioned on the terrain to provide a destination location for the wheelchair, and interconnected with other access pathways.

The size and shape of a pod is optional, however, a pod about 42 inches (1 meter) square or about 48 inches (1.2 meters) appears to be a sufficiently comfortable size for a standard size adult wheelchair. A roomy "island" pod, for example, may likely be six feet (two meters) or more square to allow positional movement of the wheelchair at the destination pod. The deployment of location pods and pathways leading to the pods, at a beach, for example, is an activity no more difficult for beach attendants than a conventional placement and set up of a beach lounge chair.

Depending on the material of construction and design preference, the pathway and/or pod may be colored in whole or in part, for example, by safety yellow, to highlight its presence, or camouflaged in an appropriate pattern to blend in with the natural environment.

The dimensions and proportions herein and the materials of fabrication depend on design considerations of durability, weight, public or institutional use considerations, aesthetics, ambient temperature, and other factors, provided however, that good design criteria for the wheelchair application, given the foregoing disclosure, are satisfied.

What is claimed is:

1. A pathway enabling transit of a four-wheeled wheelchair along a route over an uneven terrain surface formed from matter that is resistant to the rolling traction of the wheelchair, comprising a pair of longitudinally extended flexible pathways traversing the route, each having a width capable of receiving thereon the front and side wheels at one side of the wheelchair, said paths being essentially parallel to and separated apart from each other a sufficient lateral distance such that the pathways are capable of separately receiving the front and rear side wheels on each opposite side of the wheelchair, said pathways being formed from a material that is relatively porous with respect to matter forming the terrain surface said pathways being further connected and maintained the predetermined distance apart by spacer sections at longitudinal distance intervals along the route.

2. The pathway of claim 1 in which the separation distance between the paths forms an opening permitting access to a footpath in the terrain surface for an assistant who assists the person in the wheelchair over the route in the terrain defined by the pathway.

3. The pathway of claim 1, including an upwardly extending side curb extending from a longitudinal edge thereof.

4. The pathway of claim 1 anchored at a terminal, longitudinal end section thereof to a fixed support in the terrain environment.

5. The pathway of claim 1 formed from a flexible material capable of being wound into a roll when not extended over the terrain.

6. The pathway of claim 5 comprising a longitudinally extended flexible mat material sufficient in length to extend from Point A to Point B such that a route between the two points is formed when the material is unrolled over the terrain.

7. The pathway of claim 5 formed from a metal chain link material.

8. The pathway of claim 5 formed from a wire mesh material.

9. The pathway of claim 5 formed from a flexible material including therein a plurality of holes in a perforated configuration.

10. The pathway of claim 1 including a plurality of holes in the material which permit the pathways to be conformable to the terrain surface and which allow matter of the terrain surface to migrate therethrough.

11. The pathway of claim 10 in which the holes are substantially curvilinear.

12. The pathway of claim 10 in which the holes are formed in a grid-like pattern.

13. The pathway of claim 10 in which the holes are multi-sided.

14. The pathway of claim 10 in which the aggregate area of the holes is from approximately 20% to approximately 80% of the surface area otherwise defined by the material of the pathway.

15. The pathway of claim 1 formed from a material including a flexible polymer.

16. The pathway of claim 15 formed from a UV resistant polymer.

17. The pathway of claim 1 formed from a material comprising a fiber composition.

18. The pathway of claim 1 in combination with a destination pod to which the route leads, the pod being at a location on the terrain distant from the beginning point of the route, the destination pod comprising an extended wheelchair tractionable surface on the terrain sufficiently large to allow positional movement of a wheelchair.

19. The pathway of claim 1 in which the pathways are formed from a mat material including a plurality of nibs downwardly projecting toward the terrain surface from the lower surface of the mat material along an extended length and width of the material and with respect to which, the matter of the terrain surface migrates upwardly to the lower surface of the mat material.

20. The pathway of claim 19 in which the mat includes a plurality of openings in a pattern in the surface thereof.

* * * * *